United States Patent [19]

Correra et al.

[11] Patent Number: 4,756,721

[45] Date of Patent: Jul. 12, 1988

[54] HIGH SOLIDS CONTENT COAL-TAR MIXTURE

[75] Inventors: Giuseppe Correra, Taranto; Vittorio Errigo, Rome; Giansilvio Malagarini, Rome; Santi Palella, Rome; Francesco Tammaro, Naples, all of Italy

[73] Assignee: Nuova Italsider SpA, Genoa, Italy

[21] Appl. No.: 927,225

[22] Filed: Oct. 24, 1986

[30] Foreign Application Priority Data

Oct. 24, 1985 [IT] Italy ..... 48710 A/85

[51] Int. Cl.[4] ..... C10L 7/00

[52] U.S. Cl. ..... 44/7.1; 44/51; 44/7.7

[58] Field of Search ..... 44/7.1, 51, 7.7

[56] References Cited

U.S. PATENT DOCUMENTS

| | | | |
|---|---|---|---|
| 4,146,459 | 3/1979 | Burke | 44/7.1 X |
| 4,149,854 | 4/1979 | Kohn | 44/51 |
| 4,153,421 | 5/1979 | Marlin | 44/51 |
| 4,282,006 | 8/1981 | Funk | 44/51 |
| 4,358,292 | 11/1982 | Battista | 44/51 |
| 4,579,563 | 4/1986 | Burnside et al. | 44/51 |
| 4,592,759 | 6/1986 | Naka et al. | 44/51 |
| 4,657,560 | 4/1987 | Oppenlaender et al. | 44/51 |

*Primary Examiner*—Peter A. Nelson

*Attorney, Agent, or Firm*—Young & Thompson

[57] ABSTRACT

By optimizing grinding conditions it is possible to obtain a grain-size distribution of coal milled together with tar that is especially suitable for the production of high-solids (>50% by weight) coal-tar mixtures that are pumpable and easy to inject into the blast furnace.

2 Claims, No Drawings

HIGH SOLIDS CONTENT COAL-TAR MIXTURE

DESCRIPTION

This invention concerns a high-solids coal-tar mixture. More precisely it concerns the grain-size distribution of the coal that permits attainment of more than 50% solids (by weight) in the mixture without the use of additives.

The word coal in this description refers to any essentially solid carbonaceous fuel, such as coal, metallurgical coke, petroleum coke, semicoke, etc.

The use of auxiliary fuels injected at the tuyeres ensures great benefits as regards blast furnace productivity and energy consumption. However, fuel-oil, generally employed as auxiliary fuel, is a material whose cost and supply are dependent on nontechnical factors that may make its use unacceptable in plants such as the blast furnace operating in very delicate equilibrium. Other types of auxiliary fuels have thus been sought. Coal-water mixtures and coal-tar mixtures have been found interesting for a variety of reasons, essentially concerning cost, quality and availability.

Where coal-tar mixtures are concerned, one limitation to date has been the fact that when the coal content of the mixture exceeds 40% by weight, the apparent viscosity of the mixture increases very rapidly, with the result that at about 50% solids (by weight) the mixture is no longer pumpable. Furthermore, above 40% solids (by weight) the apparent viscosity of the coal-tar mixture also increases markedly with time. This is thought to be due to absorption of tar in the coal pores, thus considerably increasing the percentage coal (by volume) in the mixture.

Because of these difficulties, reported recently in papers S44 and S108 at the 103rd and 105th Meetings of the ISIJ (April 1982 and April 1983), respectively, the coal content of the coal-tar mixtures used in industrial trials in Japan on a 5050 $m^3$ blast furnace could not exceed 43% by weight (Proceedings, Fifth International Symposium on "Coal Slurry Combustion and Technology" 25–27/4/83, Tampa, USA, Vol. 1, pages 361 et seq.).

Contrary to what has been reported on the state of the art, however, it has been found surprisingly that a given coal grain-size distribution permits production of coal-tar mixtures containing more than 50% coal and having a viscosity such as to render the mixture easily pumpable and injectable, and without any marked variations with time.

According to this invention, minus 20-mm coal, selected from coking coals, difficult-to-coke coals, metallurgical coke and petroleum coke is fed to a mill together with the tar and ground to obtain the following grain-size distribution:

| | |
|---|---|
| plus 500 μm | 0 (% weight) |
| minus 500 plus 250 μm | 1–2 (% weight) |
| minus 250 plus 88 μm | 3–7 (% weight) |
| minus 88 plus 44 μm | 9–18 (% weight) |
| minus 44 plus 11 μm | 40–50 (% weight) |
| minus 11 μm | 30–45 (% weight) |

In this way, depending on the type of coal used, the actual grain-size distribution obtained and the quantity of coal in the mixture, the apparent viscosity (Haake MV II P, at 70° C., 1800s, 28 $s^{-1}$) is between 800 and 1200 cP approximately, with good stability up to fourteen days without stirring and up to about thirty days with gentle stirring. The grain-size distribution according to the invention has enabled blast-furnace-proved coal-tar mixtures containing up to 53.1% coal (by weight) to be obtained; moreover, laboratory fluidity, stability, injectability and combustion tests indicate the possibility of utilizing coal-tar mixtures containing at least 55% coal (by weight).

Attainment of the desired grain-size distribution must be studied, of course, on the basis of mill type, grinding parameters of the kind of coal employed. In any case, however, the grain-size distribution indicated above must be attained.

For the purpose of exemplification, without limiting the invention or claims thereto, indications are given below of conditions for two kinds of coal that have resulted in diverse types of mixtures.

EXAMPLE 1

A medium-high volatiles, bituminous coking coal having the following characteristics:

| Grain-size analysis (% weight) | |
|---|---|
| +15 | mm 0 |
| −15 + 8 | mm 7.08 |
| −8 + 2.83 | mm 21.24 |
| −2.83 + 1 | mm 24.57 |
| −1 + 0.25 | mm 28.50 |
| −0.25 | mm 18.61 |
| **Proximate analysis (% weight)** | |
| Moisture | 3.0 |
| Ash (db) | 8.3 |
| Volatile matter (db) | 28.2 |
| Fixed C (db) | 63.5 |
| **Ultimate analysis (% wt dry basis - db)** | |
| Ash | 8.3 |
| C | 83.5 |
| H | 4.4 |
| S | 0.9 |
| N | 1.2 |
| O | 1.7 |

Hardgrove Grinding Index (HGI) 95 and a tar having the following characteristics:

| Chemical analysis (% wt.) | |
|---|---|
| $H_2O$ | 5 |
| C (db) | 94.5 |
| H (db) | 4.5 |
| S (db) | 0.5 |

Xylene insolubles: 6%; Ash in insolubles 0.15%; LHV 36.98 MJ/kg; Specific gravity: 1.17 kg/$dm^3$; Apparent viscosity (70° C., 1800 s, 28 $s^{-1}$): 64 cP, were fed together to a four-compartment 0.42 $m^3$ ball mill with a ball-load of 711 kg the size-grading of which was

| | | | | | |
|---|---|---|---|---|---|
| Dia (mm): | 16 | 18 | 20 | 25 | 30 |
| % weight: | 12 | 13 | 25 | 30 | 20. |

The mill was operated at 38 revolutions per minute (75% of critical speed) with a production rate of 100 kg/h.

Two mixtures were made, A and B, with solids concentrations of about 43% and about 53% respectively.

The characteristics of these mixtures were as follows:

| | Mixture A | Mixture B |
|---|---|---|
| Percent coal (by weight) | 42.8 | 51.6 |
| Grain-size distribution | | |
| +500 μm | 0.4 | 0 |
| −500 + 250 μm | 0.2 | 1.8 |
| −250 + 88 μm | 5.6 | 3.2 |
| −88 + 44 μm | 8.9 | 9.3 |
| −44 + 11 μm | 34.5 | 43.9 |
| −11 μm | 50.4 | 41.8 |
| Apparent viscosity cP (70° C., 1800 s, 28 $s^{-1}$) | 645 | 928 |
| Pumpability MPa/100 m (1" pipe, V = 0.05 m/s) | — | 0.14 |

EXAMPLE 2

Coke fines having the following characteristics:

| Grain-size analysis (% weight) | |
|---|---|
| +15 | mm 0.46 |
| −15 + 8 | mm 0.10 |
| −8 + 2.83 | mm 19.95 |
| −2.83 + 1 | mm 35.20 |
| −1 + 0.25 | mm 26.60 |
| −0.25 | mm 17.69 |
| **Proximate analysis (% wt db)** | |
| Carbon | 84 |
| Volatile matter | 2.40 |
| Ash | 13.60 |

was charged together with the Example 1 tar to the same mill and was ground as per Example 1, but at a production rate of 50 kg/h. The mixtures obtained—C and D—with target solids concentrations of 44 and 53%, had the following characteristics:

| | Mixture C | Mixture D |
|---|---|---|
| Percent coke (by weight) | 44.3 | 53.1 |
| Grain-size distribution | | |
| +500 μm | 11.2 | 0 |
| −500 + 250 μm | 1.3 | 0.9 |
| −250 + 88 μm | 6.5 | 5.9 |
| −88 + 44 μm | 13.8 | 17.9 |
| −44 + 11 μm | 30.7 | 43.1 |
| −11 μm | 36.5 | 32.2 |
| Apparent viscosity cP (70° C., 1800 s, 28 $s^{-1}$) | 1090 | 950 |

Static stability, understood as being the ability of the mixture to maintain the carbonaceous solids part in suspension and to prevent it from settling out, was measured on Mixtures B and D. The test is made with a 3 mm diameter steel cylinder weighing 30 g, the measurement reported being that length of a cylinder which cannot penetrate a depth of 180 mm of mixture in the undisturbed state.

Put another way, if the solid part of the mixture does not separate out, the test cylinder penetrates completely into the mixture. If, on the other hand, solids separate out and are deposited on the bottom of the test container, the layer which forms prevents the cylinder from penetrating completely. The number of millimeters of cylinder protruding above the free surface of the mixture provides the measure of the stability of the mixture.

The values found for Mixtures B and D are as follows:

Static stability test: mm not penetrated after w weeks

| Mixture | 0w | 1w | 2w | 3w |
|---|---|---|---|---|
| B | 0 | 3 | 3 | 3 |
| D | 0 | 0 | 0 | 0 |

As is evident from these examples, grinding conditions influence grain-size distribution of the ground solid; only if the grain-size distribution falls within the ranges specified as per the invention are mixtures obtained with characteristics suitable for blast-furnace use, especially as regards pumpability and viscosity, which must be such as to permit pipeline transport of the mixture within a radius of several kilometers, followed by its injection at the blast-furnace tuyeres.

A Type B mixture has been produced in a 3.5 t/h pilot plant in a one-week campaign and the resulting mixture injected without trouble at two tuyeres of a medium size blast furnace a short distance away, producing 5500 tHM/24 h. Mixture flow rate was between 500 and 100 kg/h per tuyere; blast characteristics were: T=1200° C., Moisture 15 g/$m^3$N; $O_2$: 21%.

We claim:

1. A suspension consisting essentially of particles in coal-tar, said particles being selected from the group consisting of coal and coke and having the following size distribution:

| | |
|---|---|
| >500 μm | 0 % by weight |
| 500 to 250 μm | 1–2 % by weight |
| 250 to 88 μm | 3–7 % by weight |
| 88 to 44 μm | 9–18 % by weight |
| 44 to 11 μm | 40–50 % by weight |
| <11 μm | 30–45 % by weight |

2. A suspension as claimed in claim 1, in which said particles are more than 50% by weight of the suspension and the apparent viscocity of the suspension is from 800 to 1200 cP at 70° C.

* * * * *